US007220957B2

(12) United States Patent
Choi et al.

(10) Patent No.: US 7,220,957 B2
(45) Date of Patent: May 22, 2007

(54) HIGH INTENSITY PHOTIC STIMULATION SYSTEM WITH PROTECTION OF USERS

(75) Inventors: Peter Choi, Orsay (FR); Kenneth D Ware, Poway, CA (US)

(73) Assignee: ER2S, Inc., Poway, CA (US)

( * ) Notice: Subject to any disclaimer, the term of this patent is extended or adjusted under 35 U.S.C. 154(b) by 0 days.

(21) Appl. No.: 11/025,997

(22) Filed: Jan. 3, 2005

(65) Prior Publication Data

US 2005/0243224 A1 Nov. 3, 2005

Related U.S. Application Data

(60) Provisional application No. 60/534,058, filed on Jan. 5, 2004.

(51) Int. Cl.
*G06M 7/00* (2006.01)
*H02J 40/14* (2006.01)

(52) U.S. Cl. ..... 250/221; 250/222.1; 219/121.63; 362/234

(58) Field of Classification Search ..... 250/221, 250/222.1, 205, 214 B, 214 RC; 362/103, 362/234, 112–113, 251, 253; 315/56, 58
See application file for complete search history.

(56) References Cited

U.S. PATENT DOCUMENTS 5,248,880 A * 9/1993 Fergason ..... 250/205
6,861,611 B2 * 3/2005 Chung ..... 219/121.63

* cited by examiner

*Primary Examiner*—Georgia Epps
*Assistant Examiner*—Patrick J. Lee
(74) *Attorney, Agent, or Firm*—The Nath Law Group; Robert P. Cogan

(57) ABSTRACT

In a method and system to provide high intensity photic stimulation to disable target subjects, a high intensity light source is activated by trigger signals to produce light flashes in commanded patterns of duration and frequency. A user views a field illuminated through a shutter viewer such as shutter goggles. The goggles are gated to a light blocking state in response to trigger pulses. The light blocking state has a wider time width than the light flashes from the light source produced in response to the trigger pulses to avoid the need for close synchronization. The target subjects are exposed to the high intensity light flashes while the light flashes are blocked from the view of users. Due to a low duty cycle, the users' view through the shutter goggles is unaffected by the intermittent opacity of the shutter goggles.

25 Claims, 3 Drawing Sheets

HIGH INTENSITY PHOTIC STIMULATION SYSTEM WITH PROTECTION OF USERS

CROSS-REFERENCE TO RELATED APPLICATIONS

This application claims priority to U.S. Provisional Patent Application Ser. No. 60/534,058 filed Jan. 5, 2004, the disclosure of which is incorporated herein by reference in its entirety.

FIELD OF THE INVENTION

The present subject matter relates to a method and system for high intensity photic stimulation.

BACKGROUND OF THE INVENTION

Photic stimulation comprises application of radiant energy to an organism at a frequency and intensity to which an organism will respond. Photic stimulation varies in its effect depending on wavelength, intensity and manner of application. Low intensity photic stimulation may be used for therapeutic purposes. However, high intensity photic stimulation may be used to apply non-lethal force having a disabling effect on humans or animals, who may be referred to as target subjects. High intensity light sources are incorporated in non-lethal weapons. "High intensity" in this context has an established meaning in the art both as to level of stimulation and as to light intensity. The stimulation is generally received by the eyes and interpreted through various mechanisms in the brain.

In civil unrest situations, peace officers may have an urgent need to quickly disable individuals or groups of people. Individuals or crowds can cause significant property damage and injury or death to others. However, the urgency of restoring order does not outweigh the undesirability of the use of deadly force on the civilian population. Therefore, use of high intensity light systems is highly desirable to produce disabling effects. High intensity light sources can cause "flash blindness," which is temporary vision impairment. Recovery can take minutes to hours. Afterimages may remain for hours or days. Other effects triggered in response to high intensity photic stimulation include distraction, aversion, confusion, disorientation, fear and nausea. Strobe lights can also cause seizures to debilitate target subjects who are epileptogenic.

Users employing photic stimulation systems need to be protected from the system's effects. Using dark, neutral density goggles to reduce light reaching a user's eyes is undesirable as a measure to reduce the effect of the flashing light. The user's ability to see the when the light is not flashing may be severely limited, or if the user adapts to the dark filter, the resulting dilation of pupils in the eyes will render the user more susceptible to the light flashes because no time is provided for the eyes to adjust quickly to changing light levels.

Use of laser and non-laser light sources is reviewed in T. Donnelly, *Less Lethal Technologies —Initial Prioritisation and Evaluation Publication No.* 12/01, (Police Scientific Development Branch, Home Office Policing And Crime Reduction Group, Hertfordshire, UK, 2001). It is pointed out that laser light may cause skin damage as well as permanent eye injury. A device that dazzles at a long range may cause permanent damage at short range. Prior art devices are described which use lasers providing 100–500 mW output power. Damage is more likely when the laser light is used at night, when a target subject's pupil may have a nominal diameter of 7 mm. In daytime, a target subject's nominal pupil diameter is 2 mm. Consequently, the pupil will admit approximately ten times as much light to the retina at night as in the daytime.

Another shortcoming of laser systems is that use of laser-based devices to cause blindness violates international law. *The Convention On Prohibitions Or Restrictions On The Use Of Certain Conventional Weapons Which May Be Deemed To Be Excessively Injurious Or To Have Indiscriminate Effects* (1980), particularly *Protocol IV, Protocol Relating to Blinding Laser Weapons* (1995), (International Committee of the Red Cross, Geneva, Switzerland), prohibits the use of laser weapons causing blindness to the naked eye or eye with corrective lenses.

A number of prior systems exist for purpose of disabling of target subjects with flashing light. U.S. Pat. No. 6,367,943 discloses a shield combined with light sources which produce light pulses. The light pulses are directed to disable a target subject whom the user of the shield wishes to capture or control. The light sources comprise lasers or light emitting diodes (LEDs). These sources have particular frequencies of light emission. The patent points out that if the target subjects are aware of the value of the frequency used in standard equipment, they can employ laser goggles to block the light pulses. In one form, light sources of two different frequencies are utilized, since two frequencies cannot easily be locked by wearing laser goggles. Providing for two different wavelengths of light increases cost and complexity of the system. Additionally, the laser embodiments of this system are subject to the drawbacks of laser systems as described above.

U.S. Pat. No. 6,767,108 discloses a flash grenade comprising a layer of flash lamps mounted in a cylindrical housing. Light flashes are intended to disable hostages or non-combatants as well as perpetrators. A trigger circuit for the flash lamps is included in the grenade. There is no opportunity to remotely control the ignition of the flash lamps.

U.S. Pat. No. 5,072,342 discloses a hand-held pulsed light focused by a reflector and mounted in a simulated gun. A user points the gun at an assailant's head for the purpose of causing temporary blindness. This apparatus has a limited field of illumination, and is not suited for a user facing a number of assailants.

The above-described prior art systems do not place any particular emphasis on protecting the user who is employing the system from the effects of high intensity flashing illumination. The user may be disabled as well as the target. Even when a high intensity light source is pointed in a direction away from a user, a user could be subjected to some degree of disability or immobilization from reflected light. Also, when one user is directing the high intensity light at target subjects, there may also be other users present in the field of illumination. Consequently friend as well as foe may be disabled.

An alternative to laser goggles is seen in U.S. Pat. No. 5,756,989, which discloses color night vision goggles using an image intensifier to amplify input radiant energy from a low-luminance field of view. A "bright source detector" is used to detect incoming radiation from a laser jamming system. Output pulses gate the image intensifier to disable the image intensifier in synchronism with laser jamming pulses. The system is independent of the jamming signal. It cannot be synchronized with the jamming signal, but must operate in response to receipt of the jamming signal. The system must account for lag time in responding to the beginning and end of incoming jamming pulses.

U.S. Pat. No. 5,081,542 discloses an eye protection device including a liquid crystal light valve which provides a user an image of a scene. The light valve comprises a mechanism for absorbing energy from a laser threat directed at the user. However, the light valve cannot simply turn substantially opaque to block incoming radiation.

SUMMARY OF THE INVENTION

Briefly stated, in accordance with embodiments of the present invention, there are provided a method and system for providing high intensity photic stimulation for immobilizing or otherwise impeding or disabling a target subject while protecting the user. The photic stimulation system comprises a trigger signal circuit providing a trigger signal. A high intensity light source including a lamp is connected to the lamp trigger circuit. The lamp flashes in response to the trigger signal. A shutter viewer is provided which is switchable between a transmissive state and an attenuating state. The shutter viewer is connected to a shutter viewer trigger circuit which changes the state of the shutter viewer in response to the trigger signal. A communication circuit transmits the trigger signal to the lamp trigger circuit and to the shutter viewer trigger circuit.

In a method of high intensity photic stimulation by a light source, a trigger signal is produced to initiate production of light flashes, which may be produced in bursts having commanded durations and a selected frequency of flashes within each burst. A shutter viewer being switchable between a transmissive state and an attenuating state is provided to view a field illuminated by the light source. The trigger signal is transmitted to trigger an intense flash from the light source circuit and to switch the shutter viewer to the attenuating state in response to the trigger signal.

BRIEF DESCRIPTION OF THE DRAWINGS

The above and other objects and advantages of the present subject matter will become apparent from the following description and the accompanying drawings wherein.

DETAILED DESCRIPTION OF THE PREFERRED EMBODIMENTS

Figure 1:
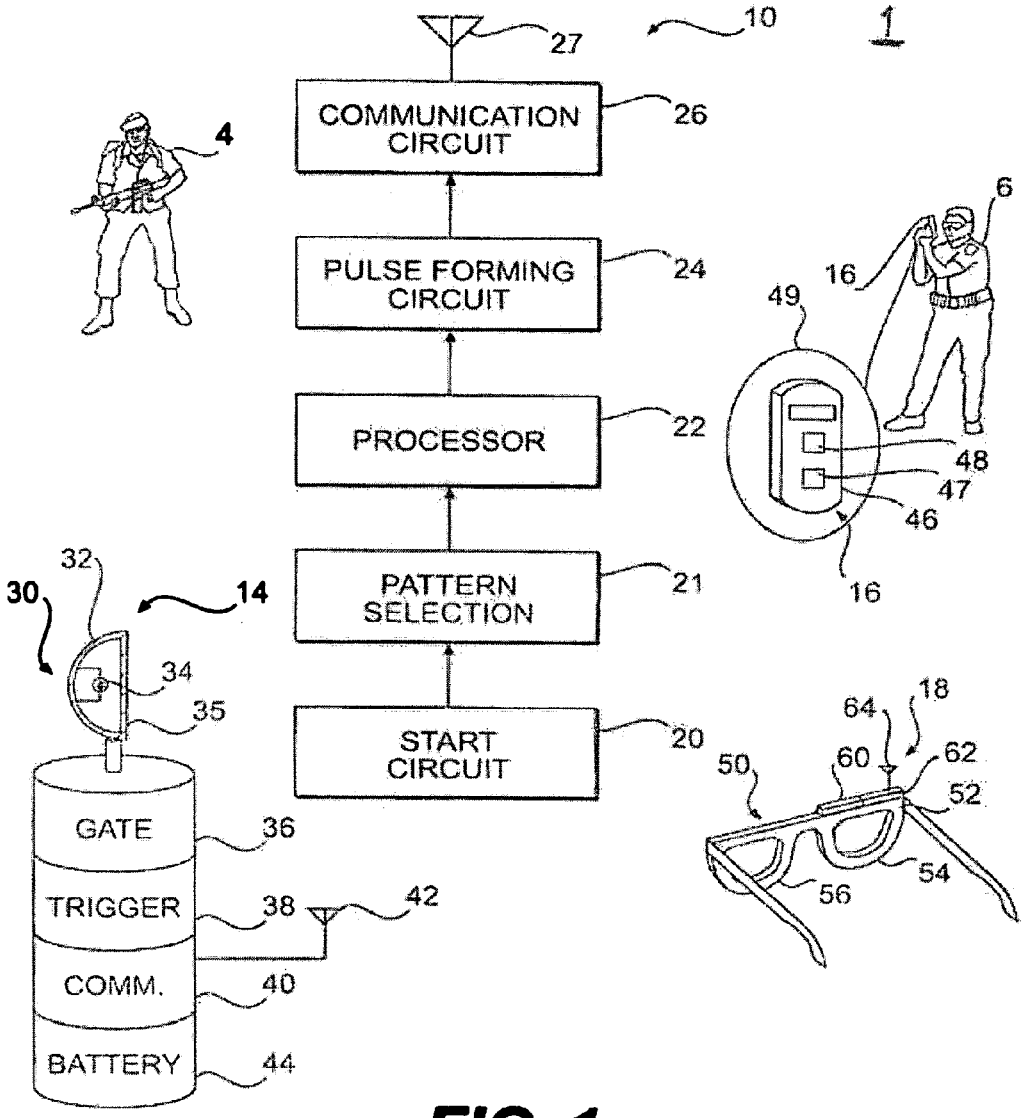
FIG. 1 is a block diagram of a system incorporating an embodiment of the invention.

FIG. 1 is a block diagram of a system 1 constructed in accordance with an embodiment of the present invention. The system 1 is operable to provide flashing light for disabling a target subject 4 while providing a user 6 freedom to operate unimpeded by the flashing light. The target subject 4 is exposed to the disabling effects of the flashing light. Means are provided to render the flashing light virtually invisible to the user 6. "Target subject 4" or "user 6" may refer either to an individual or to a plurality of individuals. Individuals need not necessarily be human.

Subsystems in the system 1 comprise a control unit 10, a lighting subsystem 14 and a viewer subsystem 18. One or more control units 10 may be utilized at one time. The control unit 10 may be remote from the lighting subsystem 14 and the viewer subsystem 18. The control unit 10 could comprise a freestanding unit used on-site with the lighting subsystem 14. Alternatively or additionally, the control unit 10 may take the form of one or more handheld remote activators 16, each carried by a user 6. As a further alternative, the control unit 10 could comprise a base station installation or be on a command vehicle. Control between various locations may also be shared. The lighting subsystem 14 may comprise one or a plurality of light sources further described below. Light sources may be hand-held, included in stationary structures or mounted on vehicles. The viewer subsystem 18 may comprise a personal, wearable viewing device, further described below, for each member of a group of users 6. Alternatively or additionally, the viewer subsystem 18 may comprise a display screen which may be at a remote location.

The control unit 10 is illustrated in block diagrammatic form as a number of discrete components. This is done for clarity in description. Many ways of embodying the functions performed by these components will suggest themselves to those skilled in the art other than the specific arrangement shown. The control unit 10 may be embodied in whole or in part by a single integrated circuit, a circuit card with discrete components, a combination of an integrated circuit and software or other means. A start circuit 20 initiates the production of light flashes. The start circuit 20 may be activated either manually or by a condition-responsive sensor as further described below. The control unit 10 includes a pattern selection circuit 21 at which a flashing pattern may be commanded. The flashing pattern is the arrangement of light pulses that will be produced. One preferred flashing pattern could comprise a periodic train of light pulses at a first frequency, of with the periodic pulse train being gated on and off at lower frequency than the first frequency. In this manner, repetitive bursts may be commanded having selected durations and a selected frequency of flashes within each burst. Alternative flashing patterns could comprise a stored aperiodic pattern, a sequence controlled by a random number generator or a combination of sequences or patterns. The pattern selection circuit 21 may include a user interface to select a pattern or may comprise a circuit establishing a preselected pattern.

The pattern selection circuit 21 may address a processor 22 to provide outputs to a pulse forming circuit 24. The pulse forming circuit 24 produces trigger pulses. Trigger pulses may be produced in any of a number of well-known ways. Different patterns may be stored in a lookup table in a memory. In this embodiment, the pattern selection circuit 21 comprises means generating an address for the lookup table. In traditional analog discrete component embodiments, the pattern selection circuit 21 may comprises means for varying values of resistance or capacitance in time constant circuits. The trigger pulses are encoded in a signal train that is transmitted by a communications circuit 26. The communications circuit 26 transmits the trigger pulses via a link 27. In one embodiment, the communications circuit is a radio frequency transmitter and the link 27 is a radio frequency antenna. Optical links could be used. An advantage of a radio frequency link is that it is not constrained by line-of-sight limitations.

The lighting subsystem 14 comprises one or more light fixtures 30. A plurality of light fixtures 30 is in a lighting subsystem 14 need not be identical. Each light fixture 30 may comprise a reflector 32 and a flashlamp 34. The flashlamp 34 may conveniently comprise a xenon gas discharge lamp which produces a flash when pulsed with a trigger voltage. Use of the reflector 32 is optional and affords the ability to direct light flashes in a particular direction. If it is desired to concentrate and direct light flashes in a particular direction, the light fixture 30 may further comprise a lens 35. A preferred form of lens is a Fresnel lens. The inherent flatness of a Fresnel lens facilitates ease in construction of the light fixture 30. At the present time, edge-emitting semiconductor sources do not provide sufficient intensity, but such devices may become available in the future. Such components would not need a reflector to provide light which is directed toward a field of illumination.

The trigger voltage to cause the flashlamp 34 to flash is supplied by a gating circuit 36. The gating circuit is operated in response to a lamp trigger circuit 38. The lamp trigger circuit 38 produces lamp triggering signals in response to the trigger signal detected or otherwise derived from a receiver 40. The receiver 40 is linked to the control unit 10 by a communications link 42. The receiver 40 may be a radio frequency receiver, and the link 42 may be a radio frequency antenna. Each light fixture 30 may be powered by a battery 44 for portable operation.

Each remote activator 16 comprises a housing 46. Many different forms of remote activators 16 may be provided. In the illustration of FIG. 1, the activator 16 comprises a start button 47 which may be operated by a user 6 to activate the start circuit 20. A pulse pattern selector 48 may be provided to select one of a plurality of flash patterns or to command particular sequences. A display 49 may be included to inform the user 6 of current settings.

Both the lighting subsystem 14 and the viewer subsystem 18 operate in response to the trigger signal provided from the control unit 10. It is desirable that the viewer system 18 is switched to a radiation blocking state before the light fixture 30 flashes. Therefore, the viewing system must have the opportunity to respond, as further described below, to the trigger signal before the lighting subsystem 14 responds to the trigger signal to flash the flashlamp 34. Various factors will affect the difference in response time to the trigger signal between viewer system 18 and the lighting subsystem 14. If, for example, the viewer system 18 is one half mile farther from the control unit 10 than the lighting subsystem 14, it will take approximately 2.7 μsec longer for the triggering signal to reach the viewer system 18 that the lighting subsystem 14. There may be differences in propagation times of the trigger signal through the viewer system 18 and the lighting subsystem 14. Additionally, a "rise-time" must be allowed for in order for the physical occurrence of the phenomenon which causes the viewer system 18 to assume its radiation blocking state after having a gating pulse applied thereto. Therefore, it is desirable to provide with the trigger circuit 38 a delay in response to the trigger signal. A delay on the order of milliseconds will allow for difference in transmission time and for the darkening of the viewer subsystem 18.

Commercially available xenon flashlamps are a suitable choice for the flashlamp 34. The xenon flashlamp provides intense, white light. The light is also incoherent. Consequently, a higher maximum illumination level may be applied to target subjects 4 without causing permanent damage that may be applied using laser light. Nominal commercially available xenon flashlamps may provide output light pulses each having a duration of 10 or 20 μsec. These flashlamps may be gated at a rate of 30 or 60 Hz. The xenon flashlamp produces a light pulse of fixed duration each time it is triggered. Halogen lamps are generally utilized at lower triggering frequencies.

The viewer subsystem 18 comprises one or more shutter viewers 50. A shutter viewer is a viewer that is transmissive in an ambient state and which is gated to increase in opacity, and which may be substantially opaque, in response to a trigger signal. Liquid crystal lenses are utilized in well-known forms of shutter viewers. One form of a shutter viewer comprises shutter goggles 52 worn by a user 6. In the prior art, a common use of shutter goggles is to alternately darken right and left lenses to produce a stereoscopic effect. In accordance with embodiments of the present invention, the shutter viewer 50 is rendered substantially opaque when light flashes from the light fixture 30 are provided. Since the light flashes are brief in duration, the shutter viewer 50 may be darkened for less than a millisecond at a time. This operation completely blocks light flashes from the light fixture 30 while leaving the vision of the user 6 substantially unaffected. The shutter viewer 50 could also or alternatively comprise a single gated lens 54 in front of an image sensor such as a video camera as further described with respect to FIG. 4 below. The video camera may provide images to a remote terminal. The shutter viewer 50 may further alternatively comprise a system in which the image sensor is gated to an "off" state in addition to or instead of gating the lens. Control of the shutter viewer 50 is active rather than passive in that the shutter viewer 50 is gated in response to a programmed trigger signal. The shutter viewer 50 is not gated in response to incoming optical signals.

In the present illustration, the shutter viewer 50 comprises a set of shutter goggles 52. The shutter goggles 52 comprise a right lens 54 and a left lens 56. Each of the lenses 54 and 56 comprises a liquid crystal light shutter. The lenses 54 and 56 are coupled to a shutter viewer trigger circuit 60. The shutter trigger circuit 60 receives input pulses from a receiver 62 coupled to a communications link 64. The receiver 62 and the communications link 64 may respectively comprise a radio frequency receiver and radio frequency antenna. The receiver 62 may be tuned to receive signals from the communications circuit 26. The lenses 54 and 56 may be connected to receive common gating signals. It is desired to render both lenses 54 and 56 substantially opaque for at least the duration of a light pulse emanating from the light fixture 30. Operation of the shutter viewer 50 needs to be synchronized with operation of the light fixture 30.

Figure 2:
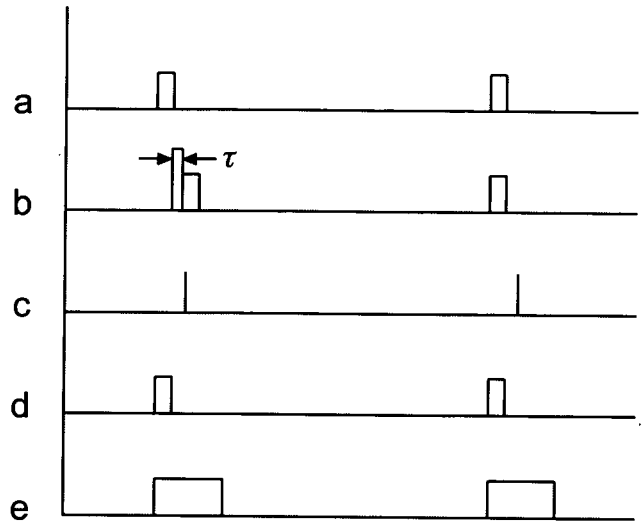
FIG. 2, consisting of FIGS. 2*a*–2*e*, is a waveform chart useful in understanding an embodiment of the present invention.

FIG. 2, consisting of FIGS. 2*a*–2*e*, is a waveform chart useful in understanding operation of the present embodiment. In FIG. 2, a common abscissa represents time. The widths of the illustrated waveforms are not drawn to scale. The ordinate is amplitude in arbitrary units. FIG. 2*a* represents the trigger signal, here a train of trigger pulses, produced by the pulse forming circuit 24. The pulses are transmitted, as, for example, on a carrier, and received by the communications circuit 40. The trigger circuit 38 derives intelligence from the communications circuit 40. Lamp triggering pulses are produced in response to the trigger signal. The shape of the illustrated lamp triggering pulses is arbitrary. Many forms of triggering pulses are well-known. The particular sort of triggering pulse depends on the circuit design selected. For purposes of the present illustration, the triggering pulses are illustrated as square waves in FIG. 2*b*. A delay t is built in to the generation of the triggering pulses. The value of t is selected to permit the shutter viewer 50 to be set to its blocking state before light pulses are produced. In many embodiments, t could have a value of 1 msec. The triggering pulses are provided to the gate circuit 36 to trigger the light fixture 30. The light pulses are illustrated in FIG. 2*c* as spikes since they are of very short duration compared to the trigger signal or lamp triggering pulses.

The trigger signal will be received at substantially the same time at the receiver 62 in the shutter viewer 50 as at the communications circuit 40 in the lighting subsystem 14. FIG. 2*d* represents a series of shutter viewer triggering pulses produced in response to the trigger signal. FIG. 2*e* illustrates application of gating voltage to the lenses 54 and 56 to render them temporarily opaque. A nominal duration for the gating signal applied to the lenses 54 and 56 is 10 msec. This period is selected to provide a window during which the flashlamp 34 will flash. The duty cycle of the blocking state of the shutter viewer 50 is greater than the duty cycle of the flashlamp 34. By having an opacity period which is long in comparison to the length of a flash, the need for precise synchronization of the opacity of the lenses 54 and 56 with the occurrence of the light flash from the flashlamp 34 is avoided. A window of 10 msec will allow for differences in time of the trigger signal reaching viewer system 18 and the lighting subsystem 14, whether the trigger signal gets to the viewer system 18 or the lighting subsystem 14 first. The time window for activation of the viewer system 18 to the blocking state must allow time for the lenses 54 and 56 to turn opaque. This period of opacity will not adversely affect vision of user 6. The period of persistence of vision is at least 30 msec. Therefore, the user 6 will view the field of illumination substantially normally, and the flashes from the flashlamp 34 will be blocked from view. In effect, the flashes are rendered "invisible" to the user 6.

Figure 3:
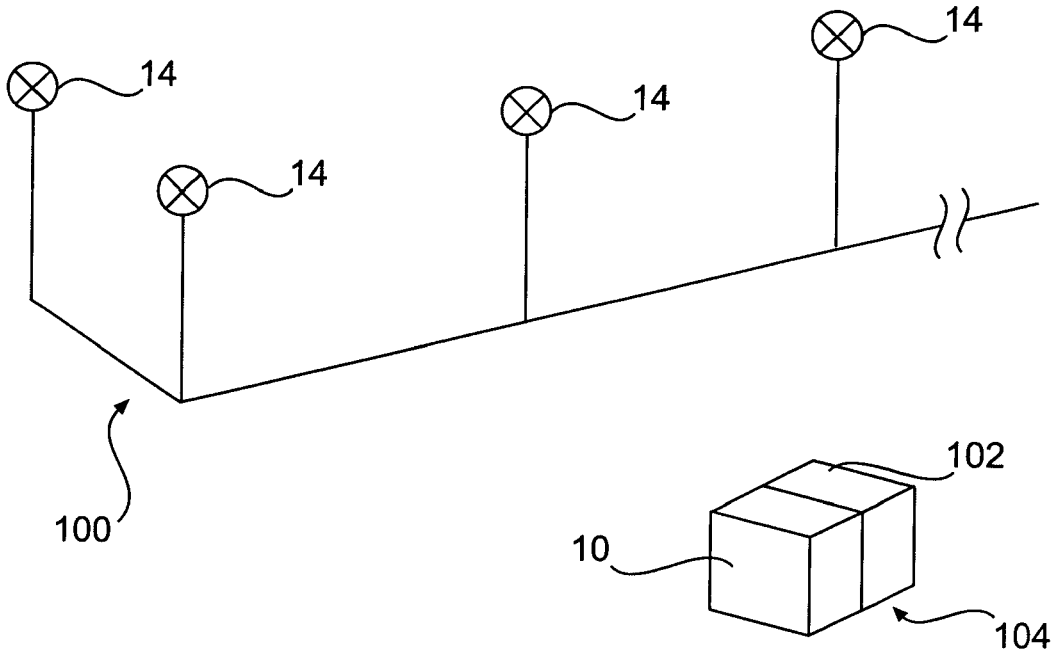
FIG. 3 is an illustration of an embodiment of the invention in operation.

FIG. 3 is an illustration of an embodiment of the present invention in use. In the embodiment of FIG. 3, the present system is used for perimeter protection. A plurality of lighting subsystems 14 are built into an enclosure 100. A sensor 102 in a housing 104 senses intruders who may comprise target subjects 4. When target subjects 4 are detected intruding, the sensor 102 enables the control unit 10 to produce a trigger signal. The control unit 10 may be combined in the housing 104 with the sensor 102. Alternatively, the control unit 10 may be remote from the sensor 102 and coupled by wire or wirelessly. Users 6 may comprise security personnel.

Figure 4:
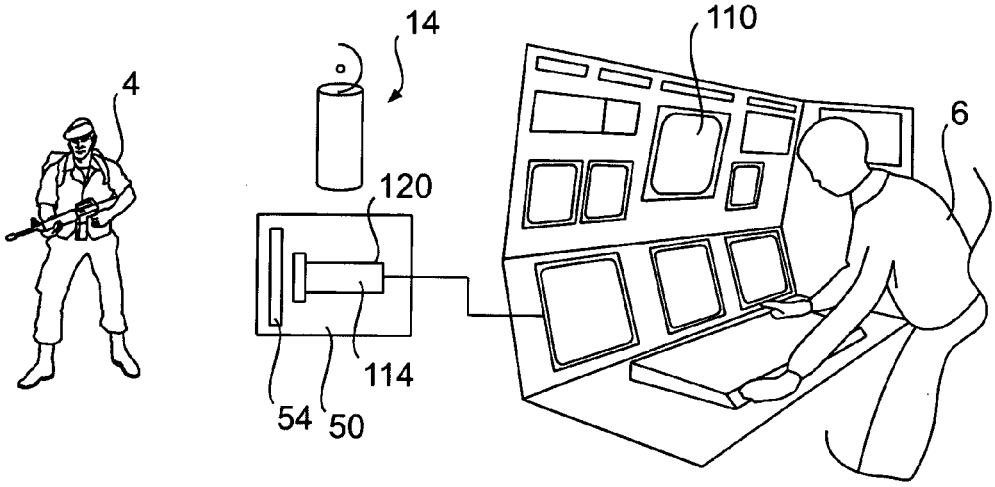
FIG. 4 is an illustration of a further embodiment of the present invention.

In the embodiment of FIG. 4, a user 6 is located at a location remote from a field of illumination. The user 6 views the field through a monitor 110. The remote monitor displays an image from a camera 114 at the remote site. The camera 114 is included in a shutter viewer 50. The gated shutter device in this embodiment is a single liquid crystal lens 54. The camera 114 comprises an image sensor, which could be, for example, an image intensifier 120. Image intensifiers are used to provide images under very low light conditions. The gated lens 54 is placed in front of the image intensifier 120 in order to protect the image intensifier 120 during the occurrence of light flashes. The shutter viewer 50 could also or alternatively comprise a single gated lens 54 in front of an image sensor such as a video camera as further described with respect to FIG. 4 below. The video camera may provide images to a remote terminal. The shutter viewer 50 may further alternatively comprise a system in which the image intensifier 120 is gated to an "off" state in addition to or instead of gating the lens 54.

Figure 5:
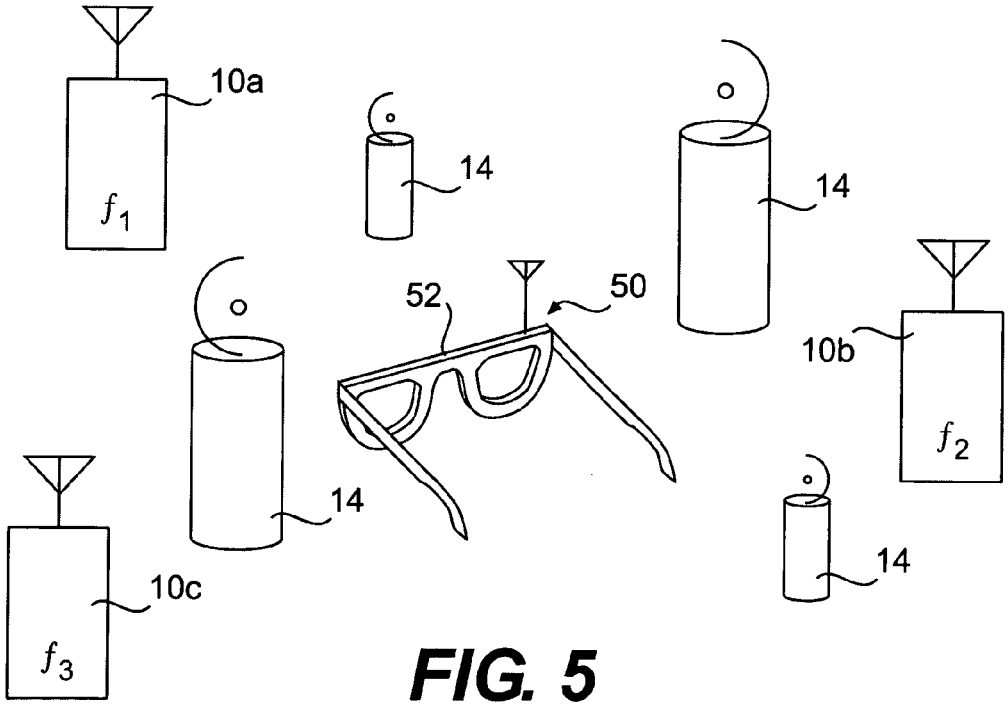
FIG. 5 is a view of a system comprising a plurality of control units.

In the embodiment of FIG. 5, a plurality of lighting subsystems 14 are provided and a plurality of control units 10 are also provided. Each control unit 10 provides a trigger signal on a separate frequency to trigger one or a selected plurality of lighting subsystems 14. Three control units 10*a*, 10*b* and 10*c* may have transmission frequencies of $f_1$, $f_2$ and $f_3$ respectively. Each of the lighting subsystems 14 is tuned to respond to one carrier frequency $f_1$, $f_2$ or $f_3$. Each shutter viewer 50 may be tuned to respond to each carrier frequency $f_1$, $f_2$ and $f_3$. The shutter viewer 50 could comprise shutter goggles as illustrated in FIG. 5, or could take other forms. Consequently, separate applications of non-lethal force may be made from separate lighting subsystems 14. Users 6 who may be in the vicinity of any or all of the lighting subsystems 14 will have their vision protected.

Embodiments of the present invention provide for reliable protection of users while providing for the application of non-lethal force to target subjects. Time synchronization is simplified in that a time window for blocking light flashes in a viewer may be much wider than the width of the light pulses and still leave the vision of a user unimpeded. The present subject matter being thus described, it will be apparent that the same may be modified or varied in many ways. Such modifications and variations are not to be regarded as a departure from the spirit and scope of the present subject matter, and all such modifications are intended to be included within the scope of the following claims.

We claim:

1. A high intensity photic stimulation system, comprising: (a) a trigger signal circuit providing a trigger signal; (b) a lighting subsystem comprising a triggerable high intensity light source; (c) a lamp trigger circuit, said light source being connected to said lamp trigger circuit to be triggered in response to the trigger signal; (d) a shutter viewer trigger circuit; (e) at least one shutter viewer switchable between a transmissive state and an attenuating state, said shutter viewer being connected to said shutter viewer trigger circuit to be triggered in response to the trigger signal, each said shutter viewer being movable to a selectable, changeable position with respect to said lighting subsystem; and (e) a communication circuit remotely locatable from said lamp trigger circuit and said shutter viewer trigger circuit and having a movable physical location with respect thereto to transmit the trigger signal to said lamp trigger circuit and to said shutter viewer trigger circuit.

2. A high intensity photic stimulation system according to claim 1, wherein said trigger signal circuit is located remotely from said lamp trigger circuit.

3. A high intensity photic stimulation system according to claim 2, wherein said light source comprises an incoherent light source.

4. A high intensity photic stimulation system according to claim 3, wherein said trigger signal circuit, said lamp trigger circuit and said shutter viewer trigger circuit are configured to provide a higher duty cycle for shutter viewer than said light source.

5. A high intensity photic stimulation system according to claim 3, wherein said trigger signal circuit, said lamp trigger circuit and said shutter viewer trigger circuit are configured to switch said shuttle viewer to the attenuating state for a longer time duration than a pulsed output of said light source.

6. A high intensity photic stimulation system according to claim 1, wherein said shutter viewer comprises shutter goggles to be worn by a user.

7. A high intensity photic stimulation system according to claim 1, wherein said shutter viewer comprises a liquid crystal lens shutter and an image sensor, said image sensor providing an output for viewing by a monitor.

8. A high intensity photic stimulation system according to claim 1, wherein said shutter viewer comprises an image sensor, said image sensor providing an output for viewing by a monitor, wherein said shutter viewer is gateable by switching said image sensor to an off state.

9. A high intensity photic stimulation system according to claim 1, comprising a plurality of lighting subsystems each responsive to the trigger signal.

10. A high intensity photic stimulation system according to claim 9, wherein said trigger circuit is included in a control unit and further comprising a plurality of control units each transmitting a separate trigger signal, and wherein each lighting subsystem is set to respond to at least one control unit.

11. A high intensity photic stimulation system according to claim 10, wherein said shutter viewer is responsive to each said control unit.

12. A high intensity photic stimulation system according to claim 1, wherein said trigger circuit is included in a control unit and wherein said system comprises a plurality of control units each transmitting a separate trigger signal, and wherein said lighting subsystem is set to respond each said control unit.

13. A high intensity photic stimulation system according to claim 12, wherein at least one said control unit comprises a remote activator.

14. A method of high intensity photic stimulation by a light source comprising: (a) producing a trigger signal having a predetermined pulse pattern; (b) providing a shutter viewer, the shutter viewer being switchable between a transmissive state and an attenuating state, to view a field illuminated by the light source and locating the shutter viewer in a selected, changeable position with respect to the light source; (c) transmitting the trigger signal to trigger pulsed transmission from the light source circuit and to switch the shutter viewer to the attenuating state in response to the trigger signal; (d) triggering the high intensity light source in response to the trigger signal; and (e) switching the shutter viewer to the attenuating state in response to the trigger signal, wherein producing the trigger signal comprises providing the trigger signal from a location selectable with respect to the light source and the shutter viewer.

15. A method of high intensity photic stimulation according to claim 14, comprising providing an incoherent light source.

16. A method of high intensity photic stimulation to claim 15, wherein said trigger signal circuit is physically remote from said shutter viewer trigger circuit.

17. A method of high intensity photic stimulation according to claim 16, wherein said trigger signal circuit, said lamp trigger circuit and said shutter viewer trigger circuit are configured to provide a higher duty cycle for shutter viewer than said light source.

18. A method of high intensity photic stimulation according to claim 16, wherein said trigger signal circuit, said lamp trigger circuit and said shutter viewer trigger circuit are configured to switch said shutter viewer to the attenuating state for a longer time duration than a pulsed output of said light source.

19. A method of high intensity photic stimulation according to claim 14, wherein viewing the field of view with said shutter viewer comprises viewing with shutter goggles.

20. A method of high intensity photic stimulation according to claim 14, wherein switching the shutter viewer comprises gating an image sensor.

21. A method of high intensity photic stimulation according to claim 14, wherein viewing the field of view with said shutter viewer comprises viewing with an image sensor through a gated shutter lens.

22. A method of high intensity photic stimulation according to claim 21, wherein viewing the field of view further comprises transmitting a signal from the image sensor to a remote monitor.

23. A method of high intensity photic stimulation according to claim 14, comprising providing a plurality of control units, each actuatable to transmit a separate control signal and providing a plurality of lighting subsystems, and operating each lighting subsystem in response to one control unit.

24. A method of high intensity photic stimulation according to claim 22, further comprising operating said shutter viewer in response to each of said control units.

25. A method of high intensity photic stimulation according to claim 14, comprising providing a control unit selectively actuatable to transmit the control signal and locating the control unit remote from said lighting subsystem.

* * * * *